US009855749B2

(12) United States Patent
Miyazaki

(10) Patent No.: US 9,855,749 B2
(45) Date of Patent: Jan. 2, 2018

(54) LIQUID DISCHARGE HEAD WITH A WIRING MEMBER FOR GROUNDING COVER, AND LIQUID DISCHARGE DEVICE, AND LIQUID DISCHARGE APPARATUS

(71) Applicant: Takeshi Miyazaki, Kanagawa (JP)

(72) Inventor: Takeshi Miyazaki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/279,707

(22) Filed: Sep. 29, 2016

(65) Prior Publication Data

US 2017/0106650 A1 Apr. 20, 2017

(30) Foreign Application Priority Data

Oct. 20, 2015 (JP) ..... 2015-206434

(51) Int. Cl.
*B41J 2/14* (2006.01)

(52) U.S. Cl.
CPC ..... *B41J 2/1433* (2013.01); *B41J 2/14233* (2013.01); *B41J 2002/14241* (2013.01); *B41J 2002/14362* (2013.01); *B41J 2002/14491* (2013.01)

(58) Field of Classification Search
CPC ... B41J 2/14072; B41J 2/17526; B41J 2/1753
See application file for complete search history.

(56) References Cited

U.S. PATENT DOCUMENTS

2006/0066675 A1* 3/2006 Ito ..... B41J 2/14201 347/50
2007/0000974 A1* 1/2007 Kubo ..... B41J 2/14072 228/180.21
2015/0266295 A1 9/2015 Miyazaki

FOREIGN PATENT DOCUMENTS

JP 11-034324 2/1999
JP 2012-200962 10/2012

* cited by examiner

*Primary Examiner* — Juanita D Jackson
(74) *Attorney, Agent, or Firm* — Cooper & Dunham LLP

(57) ABSTRACT

A liquid discharge head includes a head body, a cover, a wiring member, and a grounding pattern. The head body has a liquid discharge face in which a nozzle to discharge liquid is disposed. The cover is disposed on the liquid discharge face of the head body. The wiring member has a wiring pattern connected to the head body. The wiring member includes a portion disposed on a side wall of the head body. The grounding pattern on the wiring member is electrically conducted to the cover with the wiring member interposed between the side wall of the head body and the cover.

12 Claims, 12 Drawing Sheets

LIQUID DISCHARGE HEAD WITH A WIRING MEMBER FOR GROUNDING COVER, AND LIQUID DISCHARGE DEVICE, AND LIQUID DISCHARGE APPARATUS

CROSS-REFERENCE TO RELATED APPLICATION

This patent application is based on and claims priority pursuant to 35 U.S.C. §119(a) to Japanese Patent Application No. 2015-206434 filed on Oct. 20, 2015 in the Japan Patent Office, the entire disclosure of which is hereby incorporated by reference herein.

BACKGROUND

Technical Field

Aspects of the present disclosure relate to a liquid discharge head, a liquid discharge device, and a liquid discharge apparatus.

Related Art

A liquid discharge head may have a cover mounted on a liquid discharge face of a head body.

SUMMARY

In an aspect of the present disclosure, there is provided a liquid discharge head that includes a head body, a cover, a wiring member, and a grounding pattern. The head body has a liquid discharge face in which a nozzle to discharge liquid is disposed. The cover is disposed on the liquid discharge face of the head body. The wiring member has a wiring pattern connected to the head body. The wiring member includes a portion disposed on a side wall of the head body. The grounding pattern on the wiring member is electrically conducted to the cover with the wiring member interposed between the side wall of the head body and the cover.

In another aspect of the present disclosure, there is provided a liquid discharge device that includes the liquid discharge head.

In still another aspect of the present disclosure, there is provided a liquid discharge apparatus that includes the liquid discharge device.

In still yet another aspect of the present disclosure, there is provided a liquid discharge apparatus that includes the liquid discharge head.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
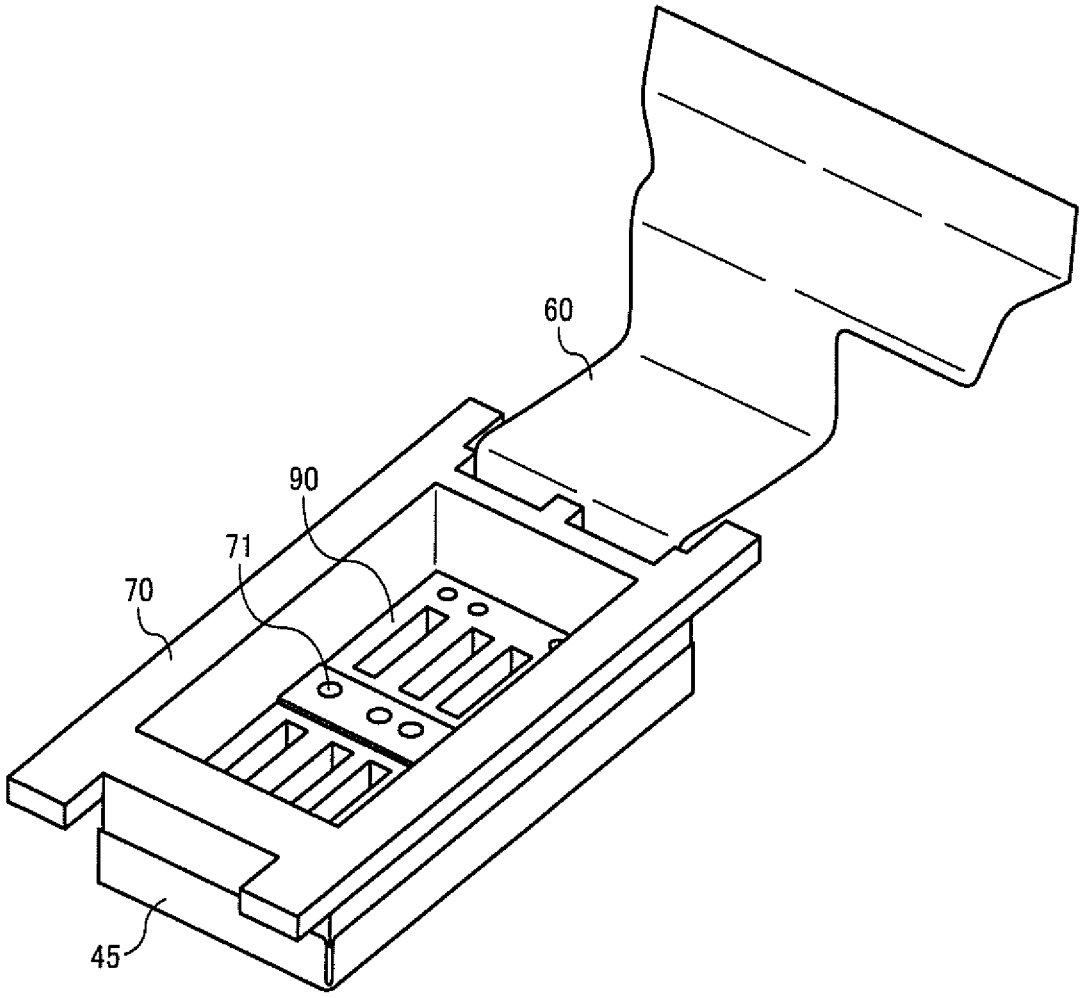
FIG. 1 is a perspective view of an example of a liquid discharge head according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Figure 2:
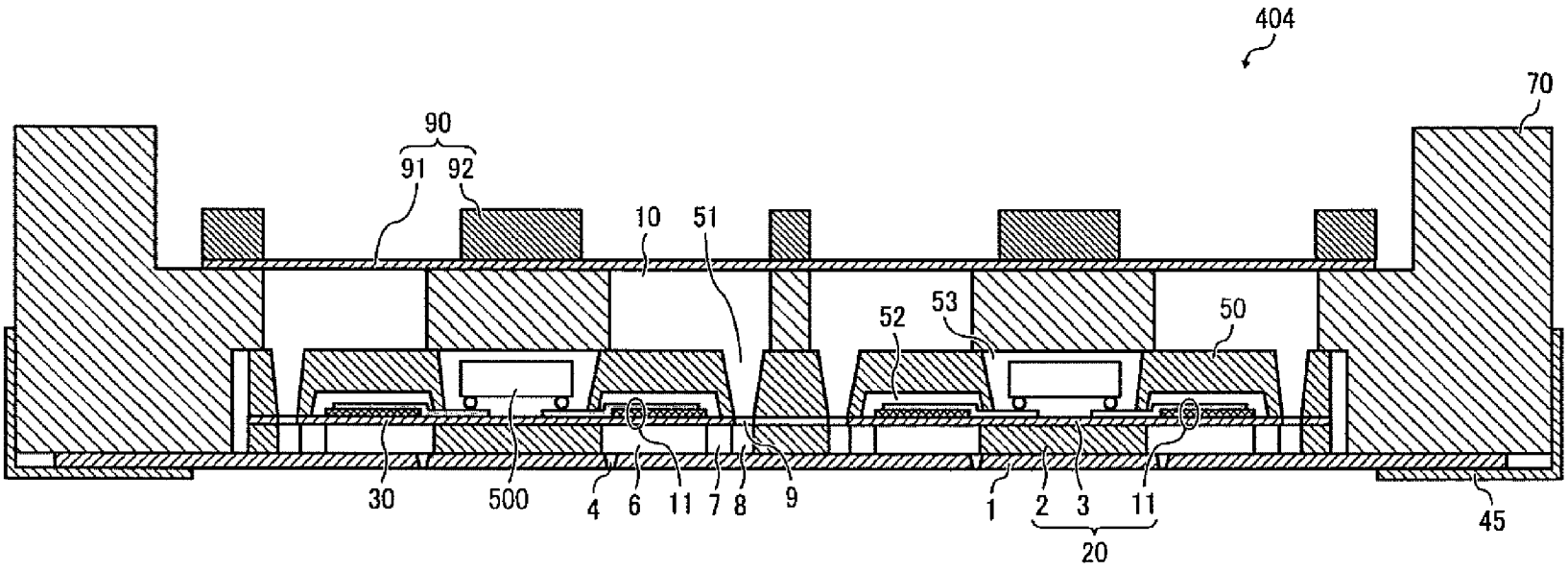
FIG. 2 is a cross-sectional view of a portion of the liquid discharge head of FIG. 1 cut along a direction perpendicular to a nozzle array direction in which nozzles are arrayed in row.
Figure 3:
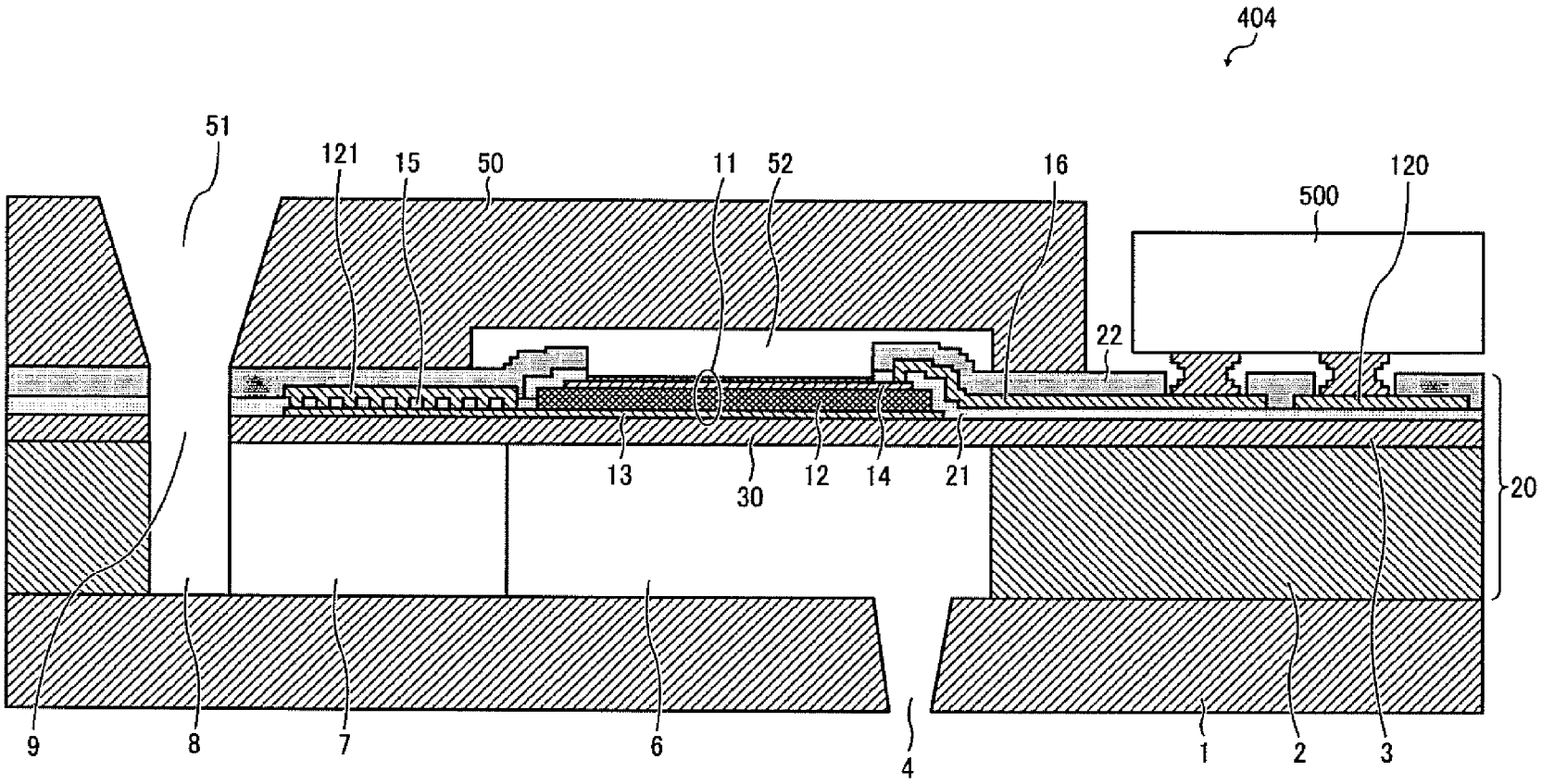
FIG. 3 is an enlarged cross-sectional view of a portion of the liquid discharge head of FIG. 2.
Figure 4:
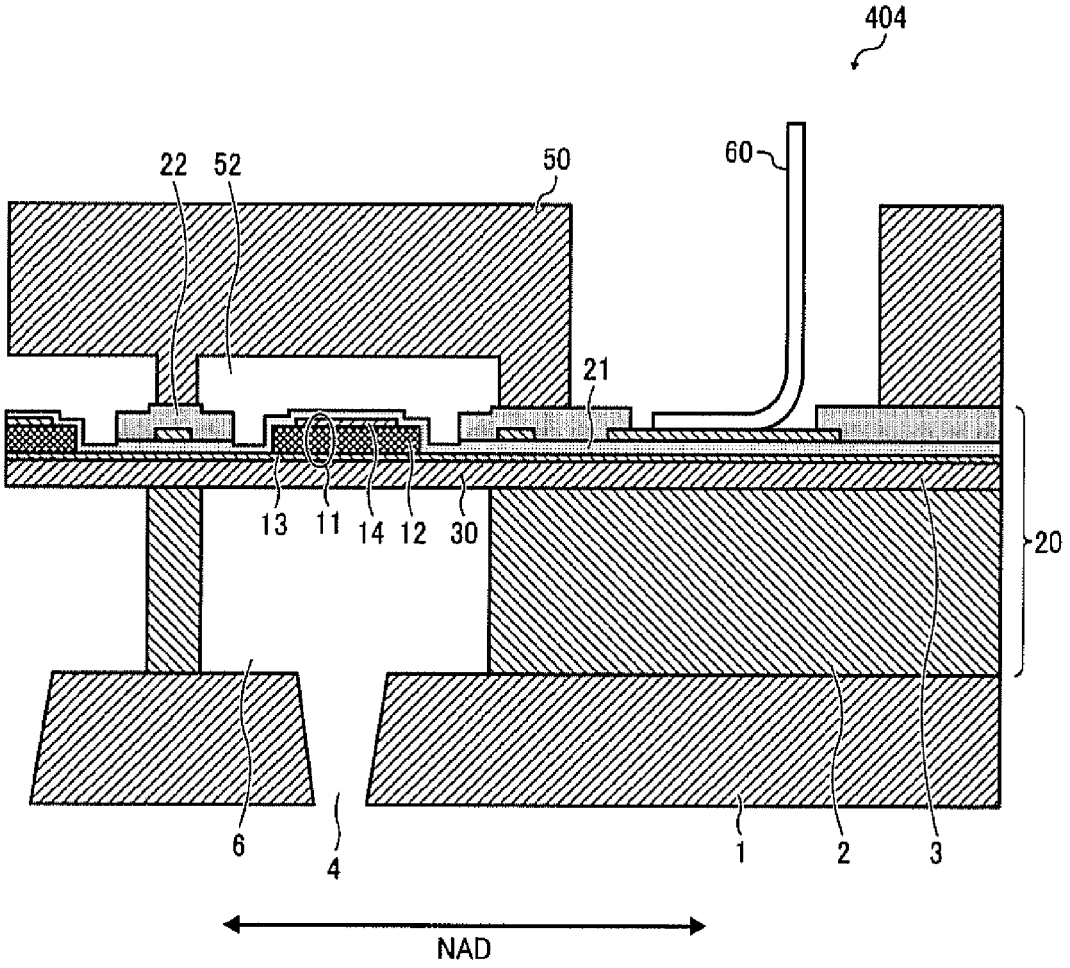
FIG. 4 is a cross-sectional view of a portion of the liquid discharge head of FIG. 2 cut along the nozzle array direction.

Referring now to the drawings, wherein like reference numerals designate identical or corresponding parts throughout the several views, embodiments of the present disclosure are described below. A liquid discharge head according to an embodiment of the present disclosure is described with reference to FIGS. 1 to 4. FIG. 1 is an exploded perspective view of the liquid discharge head according to an embodiment of the present disclosure. FIG. 2 is a cross-sectional view of the liquid discharge head of FIG. 1 cut along a direction perpendicular to a nozzle array direction in which nozzles are arrayed in row. FIG. 3 is an enlarged cross-sectional view of a portion of the liquid discharge head of FIG. 2. FIG. 4 is a cross-sectional view of a portion of the liquid discharge head of FIG. 2 cut along the nozzle array direction.

A liquid discharge head 404 according to the present embodiment includes a nozzle plate 1, a channel plate 2, a diaphragm plate 3 as a wall member, piezoelectric elements 11 as pressure generating elements (pressure generators), a holding substrate 50, a wiring member 60, and a frame substrate 70. The frame substrate 70 is also a common-liquid-chamber substrate.

In the present embodiment, the channel plate 2, the diaphragm plate 3, and the piezoelectric element 11 constitute an actuator substrate 20. Note that the actuator substrate 20 does not include the nozzle plate 1 or the holding substrate 50 that is bonded to the actuator substrate 20 after the actuator substrate 20 is formed as an independent component.

The nozzle plate 1 includes a plurality of nozzles 4 to discharge liquid. In the present embodiment, the nozzles 4 are arrayed in four rows.

With the nozzle plate 1 and the diaphragm plate 3, the channel plate 2 forms individual liquid chambers 6 communicated with the nozzles 4, fluid restrictors 7 communicated with the individual liquid chambers 6, and liquid inlets (passages) 8 communicated with the fluid restrictors 7.

The liquid inlets 8 are communicated with the common liquid chambers 10 in the frame substrate 70 via passages (supply ports) 9 of the diaphragm plate 3 and openings 51 as channels of the holding substrate 50.

The diaphragm plate 3 includes deformable vibration portions 30 forming part of walls of the individual liquid chambers 6. The piezoelectric element 11 is disposed integrally with the vibration portion 30 on a face of the vibration portion 30 opposite the individual liquid chamber 6. The vibration portion 30 and the piezoelectric element 11 form a piezoelectric actuator.

In the piezoelectric element 11, a lower electrode 13, a piezoelectric layer (piezoelectric body) 12, and an upper electrode 14 are laminated in this order from the vibration portion 30. An insulation film 21 is disposed on the piezoelectric element 11.

The lower electrode 13 as a common electrode for the plurality of piezoelectric elements 11 is connected to a common-electrode power-supply wiring pattern 121 via a common wire 15. Note that, as illustrated in FIG. 4, the lower electrode 13 is a single electrode layer straddling all of the piezoelectric elements 11 in the nozzle array direction indicated by arrow NAD.

The upper electrodes 14 as discrete electrodes for the piezoelectric elements 11 are connected to a drive integrated circuit (IC) 500 (hereinafter, driver IC 500) as a drive circuit via individual wires 16. The individual wire 16 is covered with an insulation film 22.

The driver IC 500 is mounted on the actuator substrate 20 by, e.g., a flip-chip bonding method, to cover an area between rows of the piezoelectric elements 11.

The driver IC 500 mounted on the actuator substrate 20 is connected to a discrete-electrode power-supply wiring pattern 120 to which a drive waveform (drive signal) is supplied.

A wire (wiring pattern) at one end of the wiring member 60 is electrically connected to the driver IC 500. The opposite end of the wiring member 60 is connected to a controller mounted to an apparatus body.

The openings 51 as channels communicating the common liquid chambers 10 with the individual liquid chambers 6 as described above, recessed portions 52 to accommodate the piezoelectric elements 11, and the holding substrate 50 including openings 53 to accommodate the driver ICs 500 are disposed on the actuator substrates 20.

The holding substrate 50 is bonded to a side of the actuator substrate 20 facing the diaphragm plate 3 with adhesive.

The frame substrate 70 includes the common liquid chambers 10 to supply liquid to the individual liquid chambers 6. Note that, in the present embodiment, the four common liquid chambers 10 are disposed corresponding to the four nozzle rows. Desired colors of liquids are supplied to the respective common liquid chambers 10 via liquid supply ports 71 (see FIG. 1).

A damper unit 90 is bonded to the frame substrate 70. The damper unit 90 includes a damper 91 and damper plates 92. The damper 91 is deformable and forms part of walls of the common liquid chambers 10. The damper plates 92 reinforce the damper 91.

The frame substrate 70 is bonded to an outer peripheral portion of the nozzle plate 1, to accommodate the actuator substrate 20 and the holding substrate 50, thus forming a frame of the liquid discharge heads 404.

A cover 45 is disposed to cover a peripheral area of the nozzle plate 1 and a part of the outer circumferential face of the frame substrate 70.

In the liquid discharge head 404, voltage is applied from the driver IC 500 to a portion between the upper electrode 14 and the lower electrode 13 of the piezoelectric element 11. Accordingly, the piezoelectric layer 12 expands in an electrode lamination direction (in other words, an electric-field direction) in which the upper electrode 14 and the lower electrode 13 are laminated, and contracts in a direction parallel to the vibration portion 30.

At this time, since a side (hereinafter, lower electrode 13 side) of the piezoelectric layer 12 facing the vibration portion 30 is bound by the vibration portion 30, a tensile stress arises at the lower electrode 13 side of the vibration portion 30, thus causing the vibration portion 30 to bend toward a side (hereinafter, individual liquid chamber 6 side) of the vibration portion 30 facing the individual liquid chamber 6. Accordingly, liquid within the individual liquid chamber 6 is pressurized and discharged from the nozzle 4.

Figure 5:
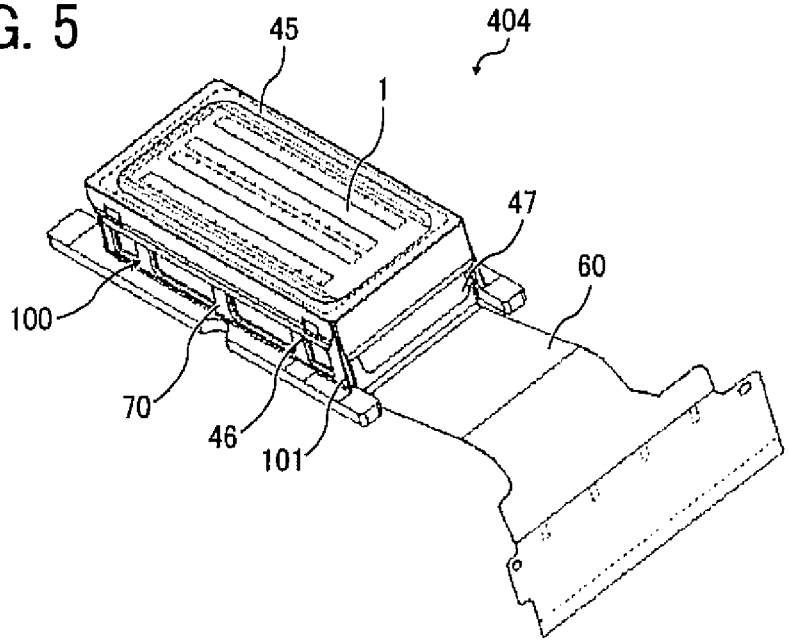
FIG. 5 is an outer perspective view of the liquid discharge head according to a first embodiment of the present disclosure.
Figure 6:
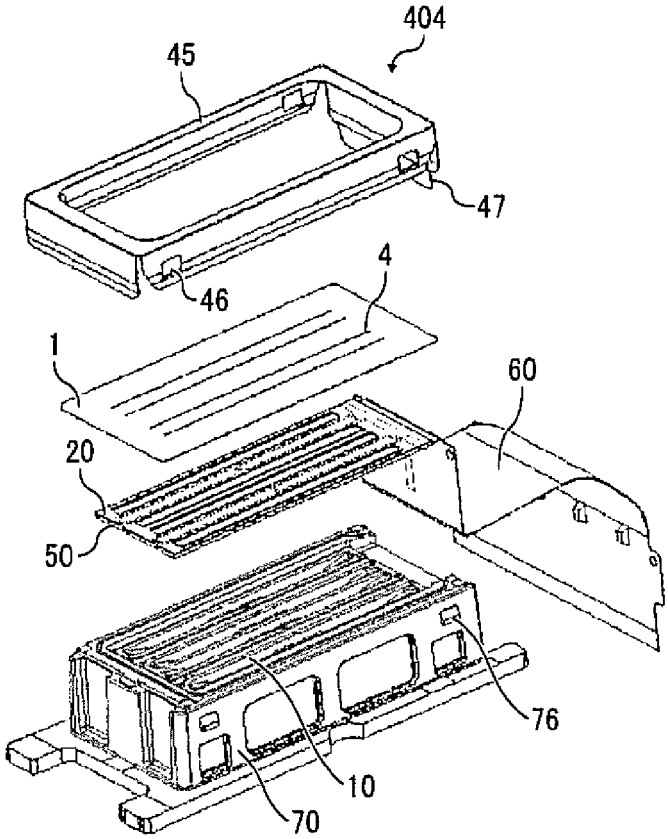
FIG. 6 is an exploded perspective view of the liquid discharge head of FIG. 5 seen from the nozzle plate side.
Figure 7:
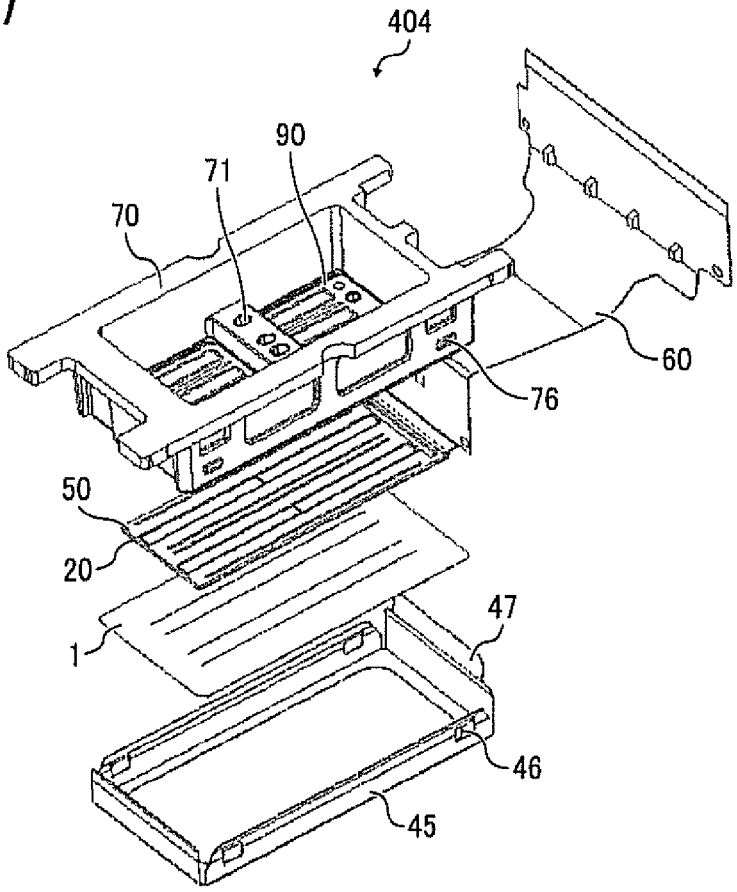
FIG. 7 is an exploded perspective view of the liquid discharge head of FIG. 5 seen from the bottom side of a frame substrate.
Figure 8:
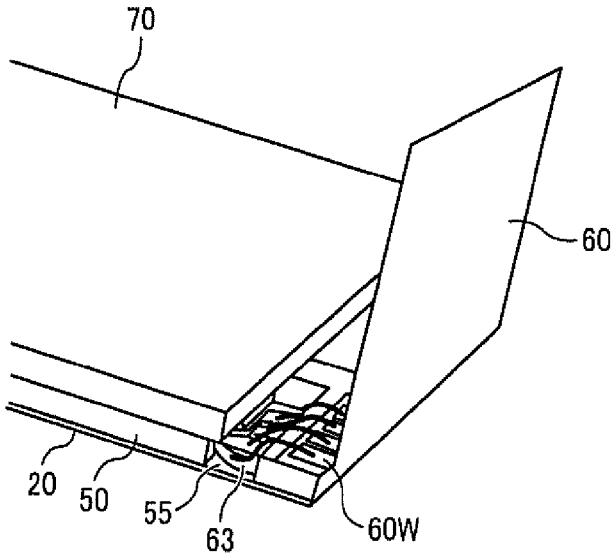
FIG. 8 is a partial, perspective view of a portion in which a wiring member, an actuator substrate, and a holding substrate are connected and fixated.
Figure 9:
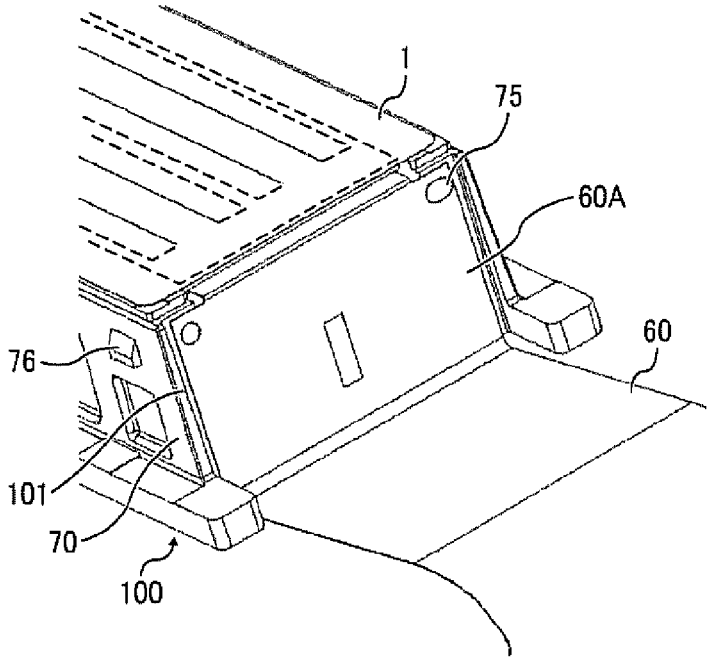
FIG. 9 is a partial, perspective view of the arrangement of the wiring member.

Next, a first embodiment of the present disclosure is described with reference to FIGS. 5 to 9. FIG. 5 is an outer perspective view of the liquid discharge head according to the first embodiment. FIG. 6 is an exploded perspective view of the liquid discharge head seen from the nozzle plate side. FIG. 7 is an exploded perspective view of the liquid discharge head seen from the bottom side of the frame substrate. FIG. 8 is a partial, perspective view of a portion in which the wiring member, the actuator substrate, and the holding substrate are connected and fixated. FIG. 9 is a partial, perspective view of the arrangement of the wiring member.

In the present embodiment, the nozzle plate 1, the channel plate 2, the diaphragm plate 3 including the piezoelectric elements 11, the holding substrate 50, and the frame substrate 70 constitute a head body 100. The cover 45 is disposed on a face (liquid discharge face) of the head body 100 at a liquid discharge side (in the present embodiment, a face of the head body 100 at a side at which the nozzle plate 1 is disposed).

The head body 100 has an internal configuration described above with reference to FIGS. 1 to 4.

In the present embodiment, as described above, the cover 45 covers the periphery of the nozzle plate 1. However, embodiments of the present disclosure are not limited to the cover covering the periphery of the nozzle plate 1. For example, a cover may be disposed at the liquid discharge side of the head body 100, to cover a portion of the head body 100. The cover 45 may be made of a conductive material(s) or include a conductive layer on the surface of a substrate made of an insulating material.

The wiring member 60 is connected to the head body 100. For example, the wiring member 60 is a flexible printed circuit (FPC) in which a wiring pattern is formed to transmit desired signals to the driver IC 500 and the piezoelectric element 11. The wiring member 60 is connected to a longitudinal end of the actuator substrate 20.

In the present embodiment, as illustrated in FIG. 8, an end of the wiring member 60 is bonded and fixed to the holding substrate 50. The holding substrate 50 has an opening 55 to expose an electrode pad 63 formed on the actuator substrate 20.

A connection pad portion 60W of the wiring member 60 is connected to the electrode pad 63 on the actuator substrate 20 by wire bonding. Note that, in the example illustrated in FIG. 4, a connection pad of the wiring member 60 is directly connected to an electrode pad of the actuator substrate 20.

Note that the electrode pad 63 of the actuator substrate 20 is an electrode pad of, for example, a pattern connected to the driver IC 500 or the common-electrode power-supply wiring pattern 121.

As illustrated in FIGS. 5 and 9, the wiring member 60 led out to a side face of the head body 100 is folded and laid along a longitudinal side face of the frame substrate 70 constituting the head body 100 (hereinafter, referred to as side wall 101 of the head body 100), and is disposed opposing the side wall 101 of the head body 100. The wiring member 60 is led out from the vicinity of the opposite face of the liquid discharge face of the head body 100.

In the present embodiment, as illustrated in FIG. 9, projections 75 are disposed on the frame substrate 70, and the wiring member 60 has holes into which the projections 75 fit. By fitting the projections 75 into the holes positions, the wiring member 60 is positioned and a portion 60A of the wiring member 60 is held on the side wall 101 of the head body 100.

Figure 10:
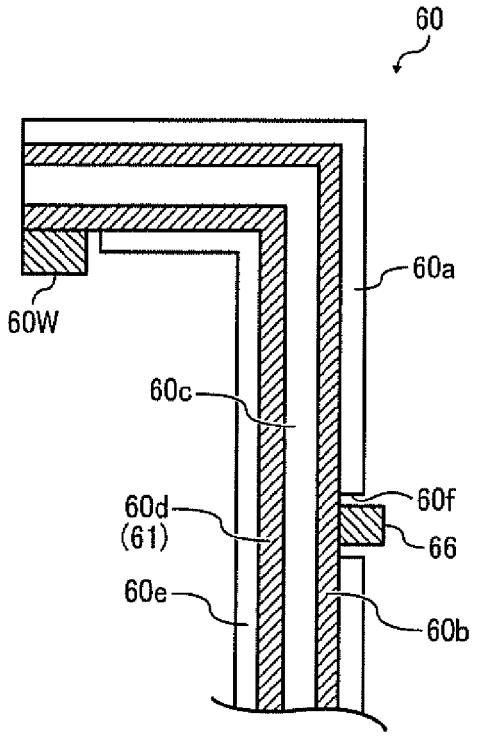
FIG. 10 is a cross-sectional view of a first example of the wiring member.

Next, a first example of the wiring member is described with reference to FIG. 10. FIG. 10 is a cross-sectional view of the first example of the wiring member.

The wiring member 60 has a layered configuration in which a protective layer 60*a*, a conductive layer 60*b*, a substrate 60*c*, a conductive layer 60*d*, and a protective layer 60*e* are stacked. For example, each of the protective layer 60*a*, the substrate 60*c*, and the protective layer 60*e* is a polyimide layer. Each of the conductive layer 60*b* and the conductive layer 60*d* is a copper (Cu) layer.

In the first example, as the conductive layer 60*b*, one or more conductive layers are used as a grounding pattern 65. In such a case, the conductive layer 60*b* constituting the grounding pattern 65 is grounded via, e.g., a wiring member connected to the wiring member 60.

Note that the conductive layer 60*b* constituting the conductive layer 60*b* is different from the conductive layer 60*d* that constitutes a wiring pattern 61 connected to the connection pad portion 60W for wire bonding, which is disposed at the end of the wiring member 60.

An opening 60*f* is disposed at a portion of the protective layer 60*a* that covers the conductive layer 60*b* constituting the grounding pattern 65. In the opening 60*f*, a contact terminal portion 66 to contact the cover 45 is formed by stacking a nickel (Ni) layer(s) and a gold (Au) layer(s). In such a case, the contact terminal portion 66 is thicker than the protective layer 60*a* and projects beyond the protective layer 60*a*.

Note that the grounding pattern 65 has the same layer configuration as a layer configuration of the connection pad portion 60W for wire bonding disposed at the end of the wiring member 60.

Figure 11:
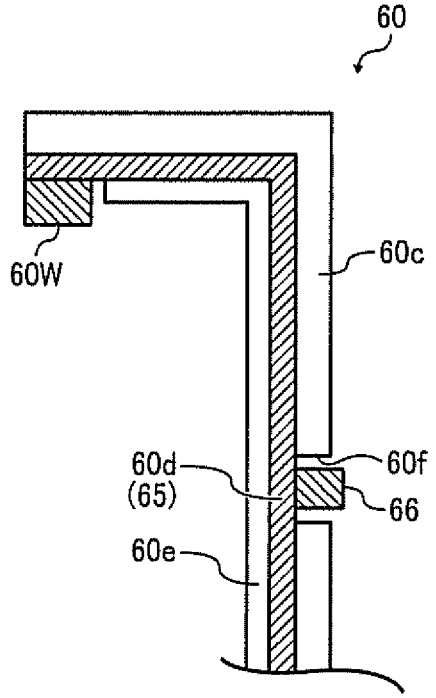
FIG. 11 is a cross-sectional view of a second example of the wiring member.
Figure 12:
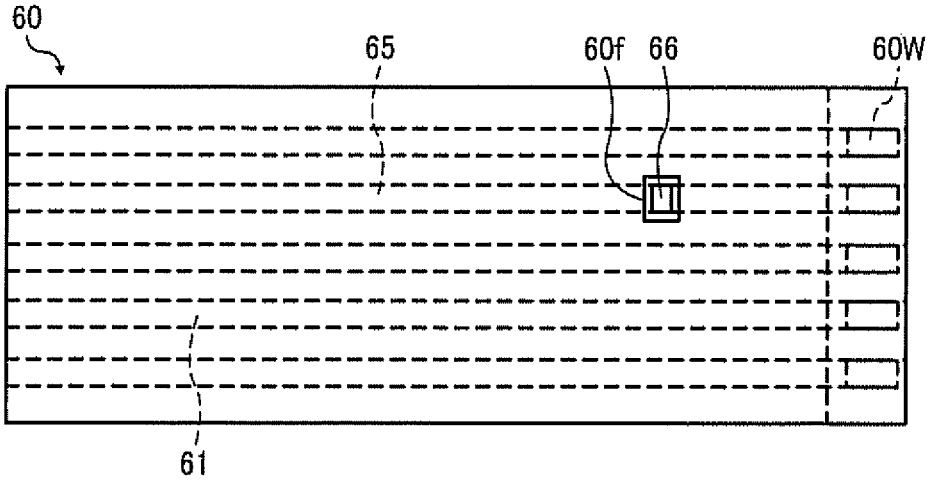
FIG. 12 is a plan view of the second example of the wiring member.

Next, a second example of the wiring member is described with reference to FIGS. 11 and 12. FIG. 11 is a cross-sectional view of the second example of the wiring member. FIG. 12 is a plan view of the second example of the wiring member.

In the wiring member 60, the substrate 60*c* also acting as a protective layer, the conductive layer 60*b*, and the protective layer 60*e* are stacked. For example, each of the substrate 60*c* and the protective layer 60*e* is a polyimide layer. The conductive layer 60*d* is a Cu layer.

In the second example, as the conductive layer 60*d*, one or more conductive layers are used as a grounding pattern 65. In such a case, the conductive layer 60*d* constituting the grounding pattern 65 is grounded via, e.g., a wiring member connected to the wiring member 60.

The opening 60*f* is disposed at a portion of the substrate 60*c* that covers the conductive layer 60*d* constituting the grounding pattern 65. In the opening 60*f*, a contact terminal portion 66 to contact the cover 45 is formed by stacking a nickel (Ni) layer(s) and a gold (Au) layer(s). In such a case, the contact terminal portion 66 is thicker than the protective layer 60*a* and projects beyond the protective layer 60*a*.

Note that the grounding pattern 65 has the same layer configuration as a layer configuration of the connection pad portion 60W for wire bonding disposed at the end of the wiring member 60.

Note that, in the first example and the second example of the wiring member 60, the contact terminal portion 66 may be a conductive adhesive filled in the opening 60*f* disposed at a portion of the protective layer 60*a* or the substrate 60*c*.

Figure 13:
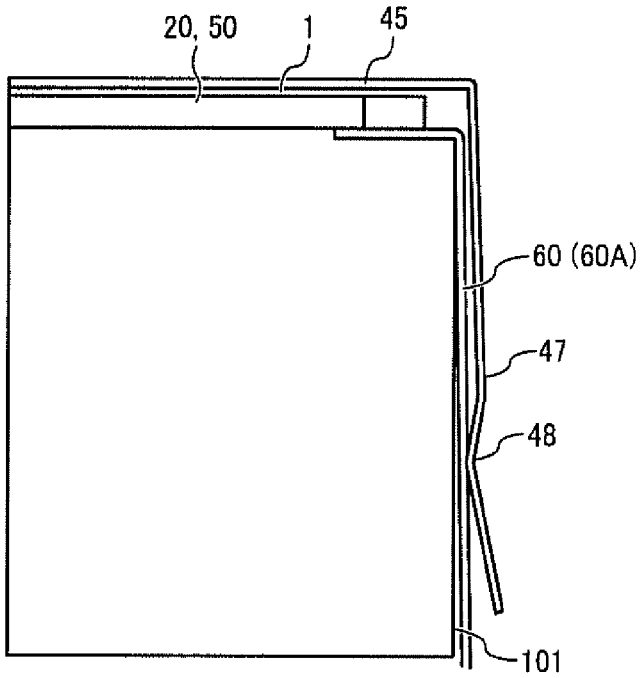
FIG. 13 is an illustration of an electrical-continuity structure of the cover and a grounding pattern of the wiring member.

Next, an electrical-continuity structure of the cover and the grounding pattern of the wiring member is described with reference to FIG. 13. FIG. 13 is an illustration of the electrical-continuity structure.

The cover 45 is formed with, for example, a metal plate having spring properties (elasticity). As illustrated in FIG. 6, holes 46 are formed at portions of the cover 45 opposing the outer periphery of the nozzle plate 1 side of the head body 100, to fit projections 76 at the outer peripheral surface of the frame substrate 70. By fitting the cover 45 to the head body 100, the holes 46 are fit to the projections 76, thus causing the cover 45 to be mounted on and retained on the head body 100.

A flap portion 47 is integrally molded with the cover 45 as a single unit. The flap portion 47 includes a contact portion 48 to contact the contact terminal portion 66 of the wiring member 60. The flap portion 47 is disposed opposing the portion 60A of the wiring member 60, which is disposed at the side wall 101 of the head body 100.

The flap portion 47 deforms to elastically press the side wall 101 of the head body 100 when the cover 45 is mounted to the head body 100. The contact portion 48 is a convex portion bent in a convex shape projecting toward the side wall 101.

With such a configuration, when the cover 45 is mounted to the head body 100, the convex-shaped contact portion 48 of the flap portion 47 of the cover 45 is pressed against and contacts the contact terminal portion 66 of the wiring member 60 held on the side wall 101 of the head body 100. In other words, by sandwiching the wiring member 60 with the side wall 101 of the head body 100 and the flap portion 47 of the cover 45, the contact portion 48 is pressed against and contacts the contact terminal portion 66.

Accordingly, the cover 45 and the grounding pattern 65 of the wiring member 60 are electrically conducted to each other.

As described above, by mounting the cover 45 to the head body 100, the cover 45 and the grounding pattern 65 of the wiring member 60 are electrically conducted to each other, thus allowing the cover 45 to be grounded with a simple configuration.

For example, even if mist occurring in liquid discharge is charged, the configuration of grounding the cover 45 can reduce adhesion of charged mist to the cover 45.

In such a case, the nozzle plate 1 may be made of a conductive member, such as a metal plate. By electrically conducting the nozzle plate 1 to the cover 45, the nozzle plate 1 can also be conducted to the grounding pattern 65 and grounded.

Even if mist occurring in liquid discharge is charged, such grounding of the nozzle plate 1 can reduce the adhesion of charged mist to the nozzle plate 1.

Figure 14:
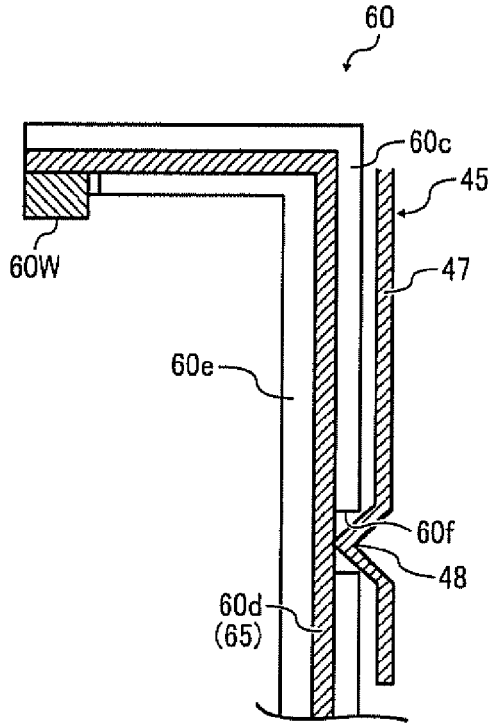
FIG. 14 is an illustration of an electrical-continuity structure of the cover and the wiring member in a second embodiment of the present disclosure.

Next, a second embodiment of the present disclosure is described with reference to FIG. 14. FIG. 14 is an illustration of an electrical-continuity structure of the cover and the wiring member in the second embodiment.

In the present embodiment, the wiring member 60 includes the conductive layer 60*d* constituting the grounding pattern 65 and the cover 45 has the contact portion 48 of a convex shape. The conductive layer 60*d* contacts the conductive layer 60*d* via the opening 60*f* that is disposed at the substrate 60*c* (in the first example of the wiring member 60, the opening 60*f* is disposed at the protective layer 60*a*).

Such a configuration obviates formation of the contact terminal portion 66 of the wiring member 60 and can achieve a simplified configuration with the opening 60*f*.

Figure 15:
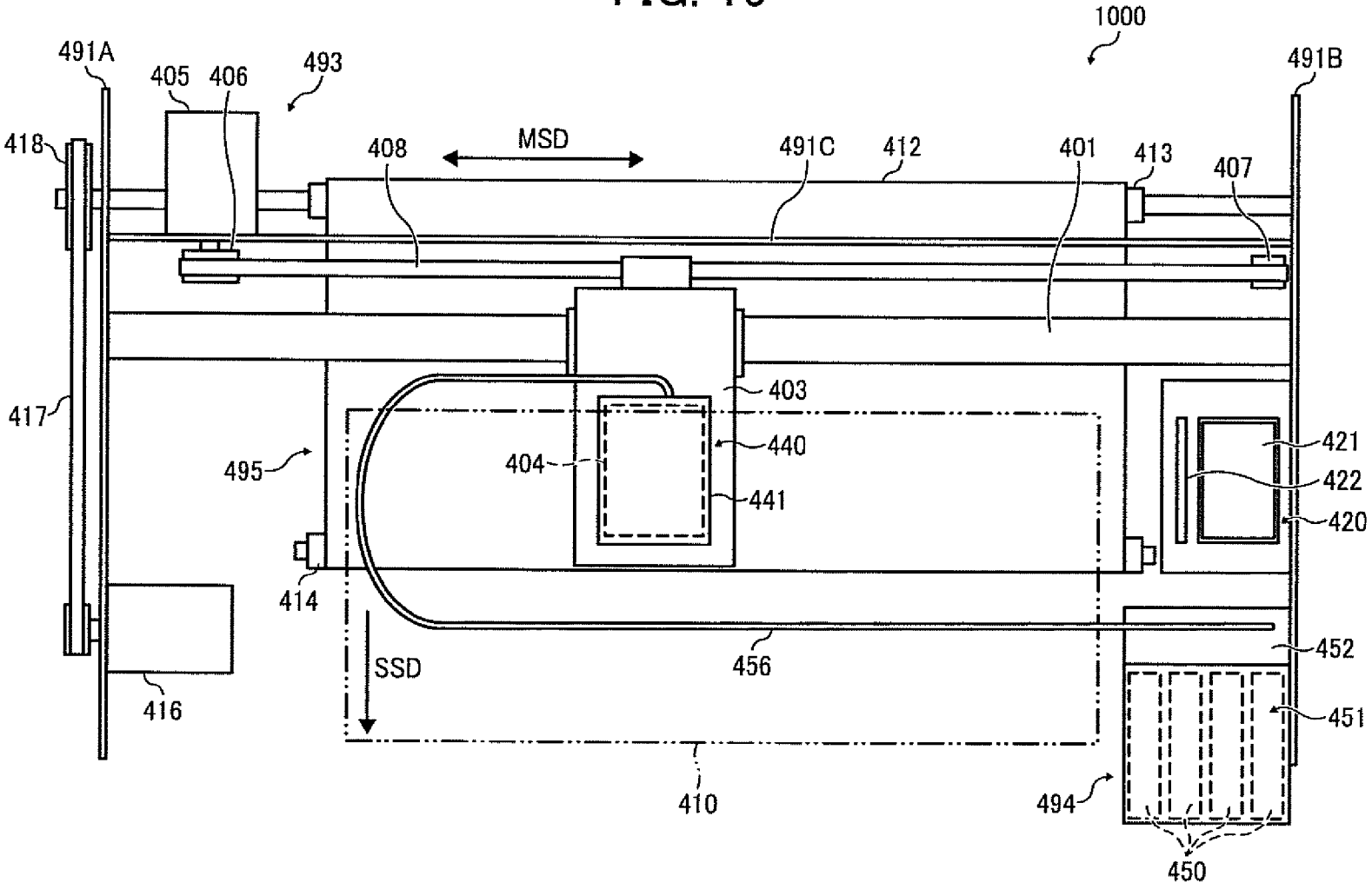
FIG. 15 is a plan view of a portion of a liquid discharge apparatus according to an embodiment of the present disclosure.
Figure 16:
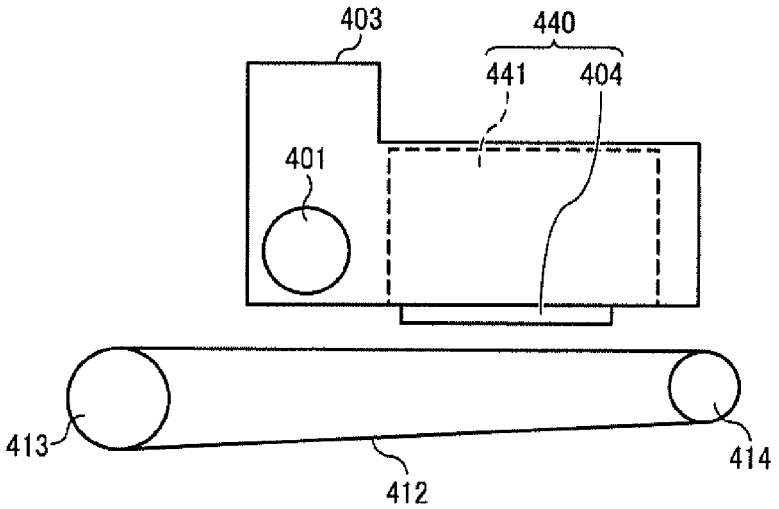
FIG. 16 is a side view of a portion of the liquid discharge apparatus of FIG. 15 including a liquid discharge device.

Next, a liquid discharge apparatus according to an embodiment of the present disclosure is described with reference to FIGS. 15 and 16. FIG. 15 is a plan view of a portion of the liquid discharge apparatus according to an embodiment of the present disclosure. FIG. 16 is a side view of a portion of the liquid discharge apparatus of FIG. 15.

A liquid discharge apparatus 1000 according to the present embodiment is a serial-type apparatus in which a main scan moving unit 493 reciprocally moves a carriage 403 in a main scanning direction indicated by arrow MSD in FIG. 15. The main scan moving unit 493 includes, e.g., a guide 401, a main scanning motor 405, and a timing belt 408. The guide 401 is laterally bridged between a left side plate 491A and a right side plate 491B and supports the carriage 403 so that the carriage 403 is movable along the guide 401. The main scanning motor 405 reciprocally moves the carriage 403 in the main scanning direction MSD via the timing belt 408 laterally bridged between a drive pulley 406 and a driven pulley 407.

The carriage 403 mounts a liquid discharge device 440 in which the liquid discharge head 404 and a head tank 441 are integrated as a single unit. The liquid discharge head 404 of the liquid discharge device 440 discharges ink droplets of respective colors of yellow (Y), cyan (C), magenta (M), and black (K). The liquid discharge head 404 includes nozzle rows, each including a plurality of nozzles 4 arrayed in row in a sub-scanning direction, which is indicated by arrow SSD in FIG. 15, perpendicular to the main scanning direction MSD. The liquid discharge head 404 is mounted to the carriage 403 so that ink droplets are discharged downward.

The liquid stored outside the liquid discharge head 404 is supplied to the liquid discharge head 404 via a supply unit 494 that supplies the liquid from a liquid cartridge 450 to the head tank 441.

The supply unit 494 includes, e.g., a cartridge holder 451 as a mount part to mount a liquid cartridge 450, a tube 456, and a liquid feed unit 452 including a liquid feed pump. The liquid cartridge 450 is detachably attached to the cartridge holder 451. The liquid is supplied to the head tank 441 by the liquid feed unit 452 via the tube 456 from the liquid cartridge 450.

The liquid discharge apparatus 1000 includes a conveyance unit 495 to convey a sheet 410. The conveyance unit 495 includes a conveyance belt 412 as a conveyor and a sub-scanning motor 416 to drive the conveyance belt 412.

The conveyance belt 412 electrostatically attracts the sheet 410 and conveys the sheet 410 at a position facing the liquid discharge head 404. The conveyance belt 412 is an endless belt and is stretched between a conveyance roller 413 and a tension roller 414. The sheet 410 is attracted to the conveyance belt 412 by electrostatic force or air aspiration.

The conveyance roller 413 is driven and rotated by the sub-scanning motor 416 via a timing belt 417 and a timing pulley 418, so that the conveyance belt 412 circulates in the sub-scanning direction SSD.

At one side in the main scanning direction MSD of the carriage 403, a maintenance unit 420 to maintain and recover the liquid discharge head 404 in good condition is disposed on a lateral side of the conveyance belt 412.

The maintenance unit 420 includes, for example, a cap 421 to cap a nozzle face (i.e., a face on which the nozzles are formed) of the liquid discharge head 404 and a wiper 422 to wipe the nozzle face.

The main scan moving unit 493, the supply unit 494, the maintenance unit 420, and the conveyance unit 495 are mounted to a housing that includes the left side plate 491A, the right side plate 491B, and a rear side plate 491C.

In the liquid discharge apparatus 1000 thus configured, a sheet 410 is conveyed on and attracted to the conveyance belt 412 and is conveyed in the sub-scanning direction SSD by the cyclic rotation of the conveyance belt 412.

The liquid discharge head 404 is driven in response to image signals while the carriage 403 moves in the main scanning direction MSD, to discharge liquid to the sheet 410 stopped, thus forming an image on the sheet 410.

As described above, the liquid discharge apparatus 1000 includes the liquid discharge head 404 according to an embodiment of the present disclosure, thus allowing stable formation of high quality images.

Figure 17:
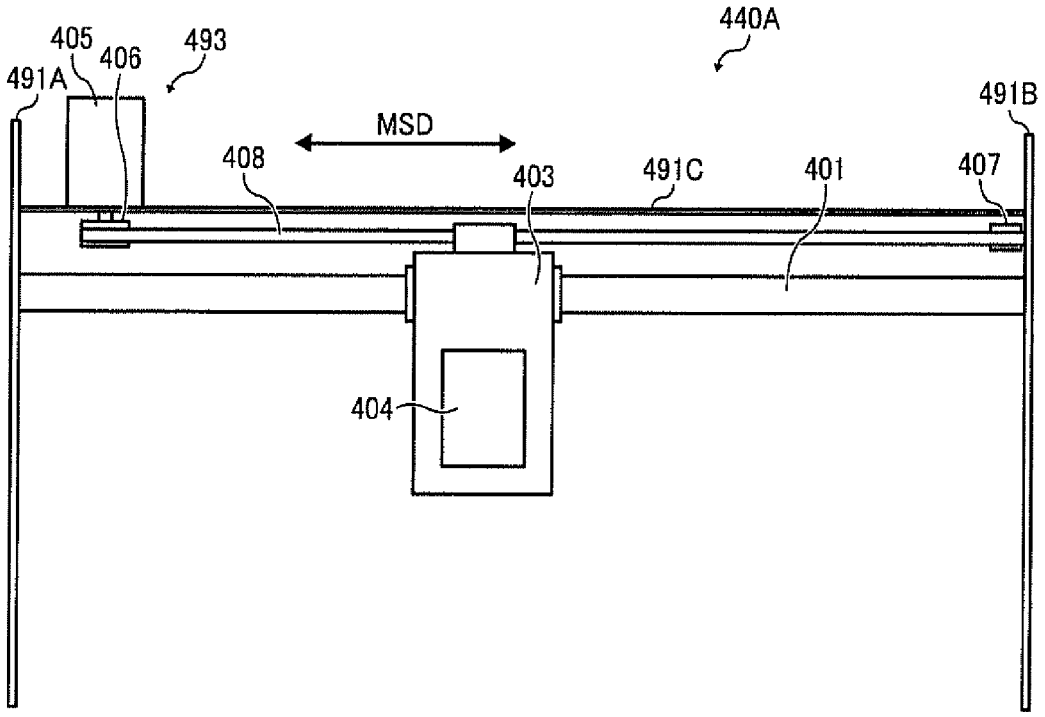
FIG. 17 is a plan view of a portion of another example of the liquid discharge device.

Next, another example of the liquid discharge device according to an embodiment of the present disclosure is described with reference to FIG. 17. FIG. 17 is a plan view of a portion of another example of the liquid discharge device (liquid discharge device 440A).

The liquid discharge device 440A includes the housing, the main scan moving unit 493, the carriage 403, and the liquid discharge head 404 among components of the liquid discharge apparatus 1000. The left side plate 491A, the right side plate 491B, and the rear side plate 491C form the housing.

Note that, in the liquid discharge device 440A, at least one of the maintenance unit 420 and the supply unit 494 may be mounted on, for example, the right side plate 491B.

Figure 18:
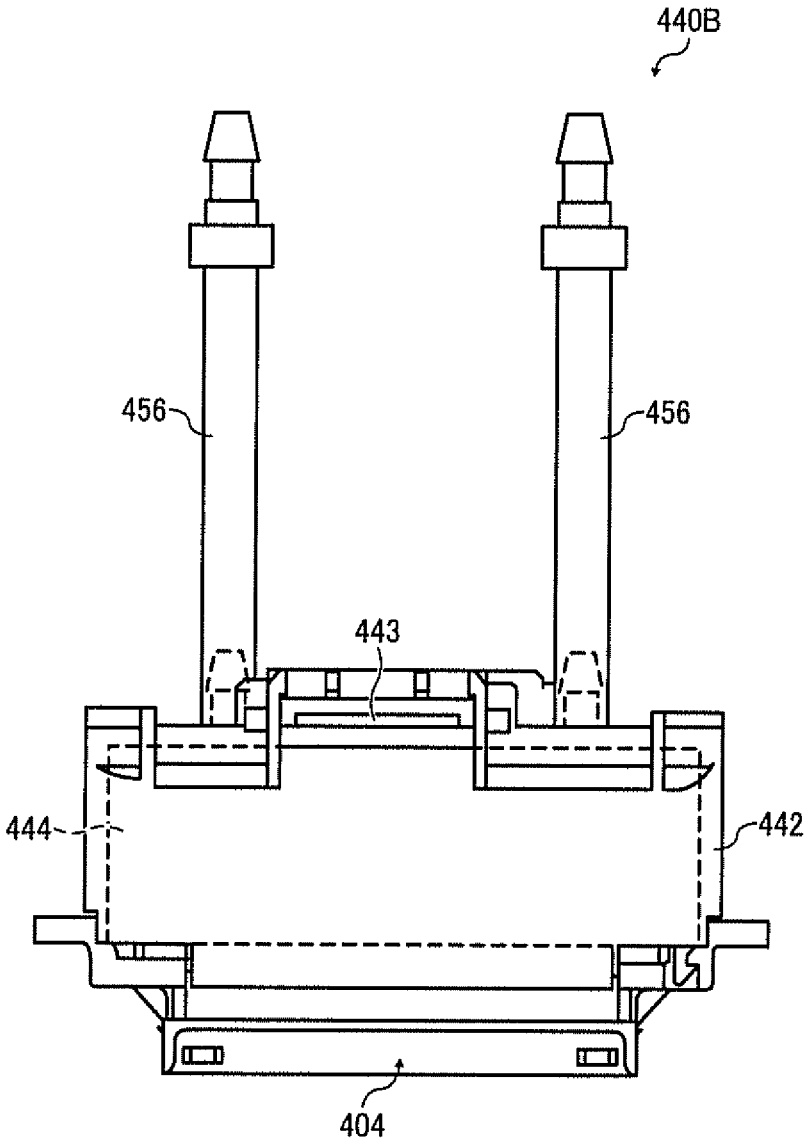
FIG. 18 is a front view of still another example of the liquid discharge device.

Next, still another example of the liquid discharge device according to an embodiment of the present disclosure is described with reference to FIG. 18. FIG. 18 is a front view of still another example of the liquid discharge device (liquid discharge device 440B).

The liquid discharge device 440B includes the liquid discharge head 404 to which a channel part 444 is mounted, and the tube 456 connected to the channel part 444.

Further, the channel part 444 is disposed inside a cover 442. Instead of the channel part 444, the liquid discharge device 440B may include the head tank 441. A connector 443 to electrically connect the liquid discharge head 404 to a power source is disposed above the channel part 444.

In the above-described embodiments of the present disclosure, the liquid discharge apparatus includes the liquid discharge head or the liquid discharge device, and drives the liquid discharge head to discharge liquid. The liquid discharge apparatus may be, for example, an apparatus capable of discharging liquid to a material to which liquid can adhere or an apparatus to discharge liquid toward gas or into liquid.

The liquid discharge apparatus may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The liquid discharge apparatus may be, for example, an image forming apparatus to discharge liquid to form an image on a medium or a solid fabricating apparatus (three-dimensional fabricating apparatus) to discharge a fabrication liquid to a powder layer in which powder is formed in layers to form a solid fabricating object (three-dimensional object).

The liquid discharge apparatus is not limited to an apparatus to discharge liquid to visualize meaningful images, such as letters or figures. For example, the liquid discharge apparatus may be an apparatus to form meaningless images, such as meaningless patterns, or fabricate three-dimensional images.

The above-described material to which liquid can adhere may include any material to which liquid may adhere even temporarily. The material to which liquid can adhere may be, e.g., paper, thread, fiber, fabric, leather, metal, plastics, glass, wood, or ceramics, to which liquid can adhere even temporarily.

The liquid may be, e.g., ink, treatment liquid, DNA sample, resist, pattern material, binder, or mold liquid.

The liquid discharge apparatus may be, unless in particular limited, any of a serial-type apparatus to move the liquid discharge head and a line-type apparatus not to move the liquid discharge head.

The liquid discharge apparatus may be, e.g., a treatment liquid coating apparatus to discharge a treatment liquid to a sheet to coat the treatment liquid on the surface of the sheet to reform the sheet surface or an injection granulation apparatus in which a composition liquid including raw materials dispersed in a solution is injected through nozzles to granulate fine particles of the raw materials.

The liquid discharge device is an integrated unit including the liquid discharge head and a functional part(s) or unit(s), and is an assembly of parts relating to liquid discharge. For example, the liquid discharge device may be a combination of the liquid discharge head with at least one of the head tank, the carriage, the supply unit, the maintenance unit, and the main scan moving unit.

Here, the integrated unit may also be a combination in which the liquid discharge head and a functional part(s) are secured to each other through, e.g., fastening, bonding, or engaging, or a combination in which one of the liquid discharge head and a functional part(s) is movably held by another. The liquid discharge head may be detachably attached to the functional part(s) or unit(s) s each other.

The liquid discharge device may be, for example, a liquid discharge device in which the liquid discharge head and the head tank are integrated as a single unit, such as the liquid discharge device 440 illustrated in FIG. 16. The liquid discharge head and the head tank may be connected each other via, e.g., a tube to integrally form the liquid discharge device. Here, a unit including a filter may further be added to a portion between the head tank and the liquid discharge head.

In another example, the liquid discharge device may be an integrated unit in which a liquid discharge head is integrated with a carriage.

In still another example, the liquid discharge device may be the liquid discharge head movably held by a guide that forms part of a main-scanning moving device, so that the liquid discharge head and the main-scanning moving device are integrated as a single unit. Like the liquid discharge device 440A illustrated in FIG. 17, the liquid discharge device may be an integrated unit in which the liquid discharge head, the carriage, and the main scan moving unit are integrally formed as a single unit.

In another example, the cap that forms part of the maintenance unit is secured to the carriage mounting the liquid discharge head so that the liquid discharge head, the carriage, and the maintenance unit are integrated as a single unit to form the liquid discharge device.

Like the liquid discharge device 440B illustrated in FIG. 18, the liquid discharge device may be an integrated unit in which the tube is connected to the liquid discharge head mounting the head tank or the channel part so that the liquid discharge head and the supply unit are integrally formed.

The main-scan moving unit may be a guide only. The supply unit may be a tube(s) only or a loading unit only.

The pressure generator used in the liquid discharge head is not limited to a particular-type of pressure generator. The pressure generator is not limited to the piezoelectric actuator (or a layered-type piezoelectric element) described in the above-described embodiments, and may be, for example, a thermal actuator that employs a thermoelectric conversion element, such as a thermal resistor or an electrostatic actuator including a diaphragm and opposed electrodes.

The terms "image formation", "recording", "printing", "image printing", and "molding" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head comprising:

a head body having a liquid discharge side;

a cover disposed at the liquid discharge side of the head body;

a wiring member having a wiring pattern connected to the head body, the wiring member including a portion disposed on a side wall of the head body; and a grounding pattern on the wiring member electrically conducted to the cover with the wiring member interposed between the side wall of the head body and the cover.

2. The liquid discharge head according to claim 1, wherein the cover includes an elastic contact portion to contact a contact terminal portion connected to the grounding pattern.

3. The liquid discharge head according to claim 2, wherein the contact portion of the cover includes a convex portion projecting toward the wiring member.

4. The liquid discharge head according to claim 2, wherein the wiring member includes:

a substrate;

a conductive layer on a surface of the substrate; and a protective layer covering the conductive layer, wherein one of the protective layer and the substrate has an opening to expose the conductive layer, and wherein the contact terminal portion is disposed in the opening in contact with the conductive layer.

5. The liquid discharge head according to claim 4, wherein the contact terminal portion is a conductive adhesive filled in the opening.

6. The liquid discharge head according to claim 1, wherein the cover includes an elastic contact portion to contact the grounding pattern.

7. The liquid discharge head according to claim 1, comprising a conductive nozzle plate that includes a nozzle and is electrically conducted to the cover.

8. A liquid discharge device comprising the liquid discharge head according to claim 1.

9. A liquid discharge device according to claim 8, wherein the liquid discharge head is integrated as a single unit with at least one of:

a head tank to store the liquid to be supplied to the liquid discharge head;

a carriage mounting the liquid discharge head;

a supply unit to supply the liquid to the liquid discharge head;

a maintenance unit to maintain and recover the liquid discharge head; and a main scan moving unit to move the liquid discharge head in a main scanning direction.

10. The liquid discharge apparatus comprising the liquid discharge device according to claim 8 to discharge the liquid.

11. A liquid discharge apparatus comprising the liquid discharge head according to claim 1 to discharge the liquid.

12. The liquid discharge head according to claim 1, wherein the cover is electrically connected to the grounding pattern on the wiring member via a convex portion projecting toward the side wall of the head body.

* * * * *